US008378560B2

(12) United States Patent
Suzuki et al.

(10) Patent No.: US 8,378,560 B2
(45) Date of Patent: Feb. 19, 2013

(54) SPARK PLUG

(75) Inventors: Akira Suzuki, Nagoya (JP); Naomichi Miyashita, Kasugai (JP); Kazuyoshi Torii, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/743,022

(22) PCT Filed: Nov. 14, 2008

(86) PCT No.: PCT/JP2008/070769
§ 371 (c)(1),
(2), (4) Date: May 14, 2010

(87) PCT Pub. No.: WO2009/063976
PCT Pub. Date: May 22, 2009

(65) Prior Publication Data

US 2010/0253203 A1 Oct. 7, 2010

(30) Foreign Application Priority Data

Nov. 15, 2007 (JP) ..... 2007-297359

(51) Int. Cl.
*H01T 13/20* (2006.01)

(52) U.S. Cl. ..... 313/142; 313/118; 313/141; 313/144

(58) Field of Classification Search ..... 313/118–145
See application file for complete search history.

(56) References Cited

U.S. PATENT DOCUMENTS

| | | | | |
|---|---|---|---|---|
| 5,488,262 | A * | 1/1996 | Takamura | 313/141 |
| 5,527,198 | A * | 6/1996 | Chiu et al. | 445/7 |
| 6,215,235 | B1 | 4/2001 | Osamura | |
| 6,304,022 | B1 | 10/2001 | Matsutani | |
| 6,853,116 | B2 * | 2/2005 | Hori et al. | 313/141 |
| 6,923,699 | B2 * | 8/2005 | Matsubara et al. | 445/7 |
| 7,187,110 | B2 | 3/2007 | Suzuki | |
| 7,306,502 | B2 * | 12/2007 | Hori | 445/7 |
| 7,382,085 | B2 | 6/2008 | Suzuki | |
| 2002/0121849 | A1 * | 9/2002 | Kanao et al. | 313/141 |
| 2003/0181121 | A1 * | 9/2003 | Matsubara et al. | 445/7 |
| 2004/0061421 | A1 * | 4/2004 | Morita et al. | 313/142 |
| 2007/0103046 | A1 * | 5/2007 | Tinwell | 313/143 |

FOREIGN PATENT DOCUMENTS

| | | | |
|---|---|---|---|
| JP | 4-366580 | A | 12/1992 |
| JP | 11-204233 | A | 7/1999 |
| JP | 11-233233 | A | 8/1999 |
| JP | 2001-60488 | A | 3/2001 |
| JP | 2004-134209 | A | 4/2004 |
| JP | 2005-123167 | A | 5/2005 |

* cited by examiner

*Primary Examiner* — Nimeshkumar Patel
*Assistant Examiner* — Thomas A Hollweg
(74) *Attorney, Agent, or Firm* — Sughrue Mion, PLLC

(57) ABSTRACT

An ignition part (80) of a ground electrode (30) includes a fused part (85) in which construction materials of a base portion (82) and a noble metal member (81) are fused and mixed by performing laser welding on the two. In the fused part (85), an average ratio P of components originated from the noble metal member (81) at points K1, L1, and M1 is equal to or greater than 80%, and an average ratio Q of components originated from the base portion at points K3, L3, and M3 is equal to or higher than 20%, and P+Q is equal to or higher than 160%. Accordingly, it is possible to obtain joining strength in the parts in the ignition part (80), thereby sufficiently preventing the generation of cracks, separation, and the like due to thermal stress.

9 Claims, 8 Drawing Sheets

SPARK PLUG

TECHNICAL FIELD

The present invention relates to a spark plug provided with a ground electrode having a needle-shaped ignition part that forms a spark discharge gap with a center electrode.

BACKGROUND ART

In recent years, there has been a requirement to enhance the solutions for environmental pollution caused by exhaust gases from internal combustion engines. Since improvement of the ignition performance of spark plugs contributes to the purification of exhaust gas, there has been a spark plug provided with a noble metal member (tip) which has a high spark consumption resistance and protrudes from the inner surface of a ground electrode toward a center electrode (for example, refer to Patent Document 1). In the spark plug having this construction, since the ground electrode can be provided to be further away from the spark discharge gap as compared with an existing one, it is difficult for a flame kernel produced in the spark discharge gap to contact the ground electrode in an initial step of the growth process. Accordingly, the inhibition of growth caused by the heat loss of a flame kernel due to contact with the ground electrode, that is, a so-called flame-quenching, is alleviated, so that it is possible to improve the ignition performance of the spark plug.

In the spark plug having this construction, since a larger thermal load is exerted on the noble metal member, there is a concern that cracks or separation may occur in the junction portion between the noble metal member and the ground electrode. Therefore, in Patent Document 1, at the junction between the noble metal member and the ground electrode, a base part (intermediate member) having a linear expansion coefficient between those of the member and the electrode is interposed between the member and the electrode. The junction portion between the noble metal member and the base part tends to have the large thermal load. Thus, by reducing thermal stress that may occur on the junction portion, the generation of cracks and separation and the like is prevented. In Patent Document 1, in order to join the noble metal member and the base part to each other, resistance welding for exerting excessive pressing force during joining is not performed, but laser welding is performed in which heat concentration is easy, the fusing depth can be increase, and internal stress hardly remains after the joining.

[Patent Document 1] JP-A-2004-134209

DISCLOSURE OF THE INVENTION

Problem that the Invention is to Solve

In the laser welding, materials (components) of the noble metal member and the base part are fused and mixed to form a fused part therebetween, however, in the fused part, ratios (hereinafter, referred to as "mixing ratio") of components originated from the two are different with each portion due to various conditions such as the irradiation position, the irradiation angle, the output, the irradiation time of the laser beam during welding. Accordingly, when the noble metal member and the base part are only joined by laser welding, the mixing ratios of the components originated from the two in the fused part are not uniform. Portions in which differences between linear expansion coefficients are partially large are likely to be generated. Recently, due to the high output and low fuel consumption of internal combustion engines, the combustion conditions of the engine have become more demanding, and there is a tendency that the thermal load caused by the cooling/heating cycle significantly influences the fused part. Although the difference between the linear expansion coefficients of the base part and the noble metal member is reduced in the state before the joining, the difference still remains, and there is a concern of cracks, separation, and the like in the portion where the mixing ratios of the components originated from the two in the fused part are not uniform.

In order to solve the above-mentioned problems, it is an object of the invention is to provide a spark plug which can prevent the generation of cracks, separation, and the like in a fused part formed at a junction portion between a noble metal member and a base part in an ignition part protruding from a ground electrode by regulating the distribution of the components originated from the two.

According to a first aspect of the invention, a spark plug is provided which comprises:

a center electrode;

an insulator which has an axial hole extending along an axial direction thereof and holds the center electrode in the axial hole;

a metal shell which circumferentially surrounds and holds the insulator;

a ground electrode which has one end portion that is joined to a front end surface of the metal shell and the other end portion that is bent such that a side surface thereof faces a front end portion of the center electrode; and an ignition part which protrudes from the side surface toward the center electrode by at least 0.5 mm, at a position opposed to the front end portion of the center electrode, on the side surface of the other end portion of the ground electrode, wherein the ignition part includes:

a base part which mainly contains Ni and has a shape protruding from the side surface toward the center electrode;

a noble metal member which mainly contains noble metal, is joined to a protruding front end of the base part, and forms a spark discharge gap between itself and the front end portion of the center electrode; and a fused part formed by laser-welding the noble metal member and the base part from a side to fuse construction materials of the two together, wherein when viewed from a cross-section of the ignition part bisected by a plane parallel with a protruding direction of the ignition part, the fused part is formed between the noble metal member and the base part, into a shape extending from each of one side surface of the ignition part and the other side surface in a direction perpendicular to the protruding direction of the ignition part, toward the center line that passes through the center between the both side surfaces along the protruding direction of the ignition part, wherein, in a cross-section of the ignition part, where a point A represents a position of a boundary between the noble metal member and the fused part at the one side surface, a point B represents a position of a boundary between the base part and the fused part at the one side surface, a point C represents a position of a boundary between the noble metal member and the fused part, which is closest to the center line, a point D represents a position of a boundary between the base part and the fused part, which is closest to the center line, a point E, a point F and a point G represent three equal division points dividing a line segment AC as a straight line connecting the point A and the point C into four equal parts, respectively, in the order from the point A, a point H, a point I, and a point J represent three equal division points dividing a line segment BD as a straight line connecting the point B and the point D into four equal parts, respectively, in the order from the point B, a point K1, a point K2, and a point K3 represent three equal division points dividing a line segment EH as a straight line connecting the point E and the point H into four equal parts, respectively, in the order from the point E, a point L1, a point L2, and a point L3 represent three equal division points dividing a line segment FI as a straight line connecting the point F and the point I into four equal parts, respectively, in the order from the point F, and a point M1, a point M2, and a point M3 represent three equal division points dividing a line segment GJ as a straight line connecting the point G and the point J into four equal parts, respectively, in the order from the point G, an average ratio P of components originated from the noble metal member among components of the fused part at the points K1, L1, and M1 satisfies P≧80 [%], an average ratio Q of components originated from the base part among the components of the fused part at the points K3, L3, and M3 satisfies Q≧20 [%], and P+Q≦160 [%] is satisfied.

According to a second aspect of the invention, a spark plug is provided which comprises:

a center electrode;

an insulator which has an axial hole extending along an axial direction thereof and holds the center electrode in the axial hole;

a metal shell which circumferentially surrounds and holds the insulator;

a ground electrode which has one end portion that is joined to a front end surface of the metal shell and the other end portion that is bent such that a side surface thereof faces a front end portion of the center electrode; and an ignition part which protrudes from the side surface toward the center electrode by at least 0.5 mm, at a position opposed to the front end portion of the center electrode, on the side surface of the other end portion of the ground electrode, wherein the ignition part includes:

a base part which mainly contains Ni and has a shape protruding from the side surface toward the center electrode;

a noble metal member which mainly contains noble metal, is joined to a protruding front end of the base part, and forms a spark discharge gap between itself and the front end portion of the center electrode; and a fused part formed by laser-welding the noble metal member and the base part from a side to fuse construction materials of the two together, wherein when viewed from a cross-section of the ignition part bisected by a plane parallel with a protruding direction of the ignition part, the fused part is formed between the noble metal member and the base part, into a shape extending from each of one side surface of the ignition part and the other side surface in a direction perpendicular to the protruding direction of the ignition part, toward the center line that passes through the center between the both side surfaces along the protruding direction of the ignition part, wherein, in a cross-section of the ignition part, where a point A represents a position of a boundary between the noble metal member and the fused part at the one side surface, a point B represents a position of a boundary between the base part and the fused part at the one side surface, a point C represents a position of a boundary between the noble metal member and the fused part, which is closest to the center line, a point D represents a position of a boundary between the base part and the fused part, which is closest to the center line, a point E, a point F and a point G represent three equal division points dividing a line segment AC as a straight line connecting the point A and the point C into four equal parts, respectively, in the order from the point A, a point H, a point I, and a point J represent three equal division points dividing a line segment BD as a straight line connecting the point B and the point D into four equal parts, respectively, in the order from the point B, a point K1, a point K2, and a point K3 represent three equal division points dividing a line segment EH as a straight line connecting the point E and the point H into four equal parts, respectively, in the order from the point E, a point L1, a point L2, and a point L3 represent three equal division points dividing a line segment FI as a straight line connecting the point F and the point I into four equal parts, respectively, in the order from the point F, and a point M1, a point M2, and a point M3 represent three equal division points dividing a line segment GJ as a straight line connecting the point G and the point J into four equal parts, respectively, in the order from the point G, an average ratio P of components originated from the noble metal member among components of the fused part at the points K1, L1, and M1 satisfies P≧60 [%], an average ratio Q of components originated from the base part among the components of the fused part at the points K3, L3, and M3 satisfies Q≧20 [%], and P+Q≦160 [%] is satisfied.

In the spark plug according to the first aspect of the invention, the average ratio P of the components originated from the noble metal member at portions in the fused part which are close to the noble metal member, that is, points K1, L1, and M1 is equal to or higher than 80%. Since laser welding is performed aiming at the joining surface between the noble metal member and the base part, the mixing ratio of the components originated from the noble metal member, that is, noble metal is high in the vicinity of the boundary between the fused part and the noble metal member. At these portions, the average ratio P of the components originated from the noble metal member is equal to or higher than 80% as described above, so that it is possible to obtain sufficient resistance (strength to maintain the junction state) to the thermal stress exerted on the vicinity of the boundary between the noble metal member and the fused part by the thermal load due to the operating of an internal combustion engine.

Regulating the average ratio P to be equal to or higher than 80% is required to guarantee high quality, and according to the aspect of the invention, the regulation is derived under severe experimental conditions. Therefore, even when the regulation on the average ratio P is derived under more moderate experimental conditions, which are closer to the conditions for the practical use of the spark plug, it is possible to guarantee sufficient resistance to the thermal stress exerted on the vicinity of the boundary between the noble metal member and the fused part. According to a second aspect of the invention, the average ratio P is equal to or higher than 60%. According to the second aspect, even when the average ratio P is equal to or higher than 60%, it is possible to guarantee sufficiently high quality, that is, it is possible to obtain sufficient resistance to the thermal stress exerted on the vicinity of the boundary between the noble metal member and the fused part.

On the other hand, according to the first and second aspects of the invention, the average ratio Q of the components originated from the base part at the portions close to the base part in the fused part, that is, the points K3, L3, and M3 is equal to or higher than 20%. In the fused part, the mixing ratio of the components originated from the base part, that is, Ni is high in the vicinity of the boundary between the fused part and the base part. Here, the noble metal member mainly contains noble metal, however, the base part mainly contains Ni, so that the materials of the two are different. Therefore, resistance to the thermal stress exerted on the vicinity of the boundary between the noble metal member and the fused part and resistance to the thermal stress exerted on the vicinity of the boundary between the fused part and the base part are different. Since heat that the ignition part receives when using the spark plug is transferred from of the base part, the thermal stress exerted on the vicinity of the boundary between the noble metal member and the fused part and the thermal stress exerted on the vicinity of the boundary between the base part and the fused part are different. From the difference of conditions, in the fused part, the mixing ratios of the components originated from the noble metal member at portions close to the noble metal member, and the mixing ratios of the components originated from the base part at portions close to the base part are not uniform. Therefore, the generation of cracks, separation, and the like due to the thermal stress can be sufficiently prevented, and it is preferable that the average ratio Q of the components originated from the base part be equal to or higher than 20%.

According to the first and second aspects of the invention, P+Q is regulated to be equal to or less than 160%. Accordingly, it is possible to prevent an increase in the difference between the mixing ratios of the components originated from the noble metal member at portions close to the noble metal member and the components originated from the base part at portions close to the base part in the fused part. That is, the fused part is likely to have the portions each having different mixing ratio of components, and these portions tend to cause differences in linear expansion coefficients therebetween. According to the present invention, differences in linear expansion coefficients of the portions can be relatively small. As a result, it is possible to prevent the generation of cracks, separation, and the like and maintain stronger welding.

There may be cases where the noble metal member contains the same material as that of the base part in addition to the noble metal. In the fused part, the components of the noble metal member and the components of the base part are fused. In order to specify the components originated from the noble metal member in components of the points K1, L1, M1 which are the same as those of the base part observed at these portions, components (hereinafter, referred to as "specific components") that are not contained in the base part are specified from the composition of the noble metal member, and the content rate of the specific components at the points K1, L1, and M1 in the fused part is obtained. On the basis of the composition of the noble metal member, the mixing ratio of the components originated from the noble metal member at the points K1, L1, and M1 is estimated. This is also applied to the points K3, L3, and M3 on the base part side.

Although the ignition part is disposed at a position opposed to the front end portion of the center electrode, the opposing position referred in the first and the second aspects of the invention does not strictly refer to a state where the surfaces of the front end portion and the ignition part which are face each other are parallel with each other, nor does it refer to a construction in which the center electrode and the ignition part are strictly aligned along the axis. That is, when a specific level of power is supplied to the spark plug according to the first and second aspects of the invention, it is only necessary to form a spark discharge gap between the front end portion of the center electrode and the ignition part.

A cross-section bisecting the ignition part according to the first and second aspects of the invention refers to a plane including the center line of the ignition part. Therefore, when the ignition part is cylindrical, it is referred to as a plane including the axis thereof. On the other hand, when the shape of the cross-section of the ignition part perpendicular to the protruding direction is irregular, a position of average coordinates when an arbitrary portion in a cross-section in the protruding direction is shown as coordinates is perceived as the center position in the cross-section in the protruding direction. A straight line closest to each center position of a series of the cross-sections is perceived as the center line of the ignition part, and the cross-section of the ignition part including the center line is seen.

According to the first and second aspects of the invention, a "main component" is referred to as the components having the highest content rate (wt %) among all of the components containing the component (element or compound). For example, in the case where Ni is the main component, the content rate of the Ni element is higher than other components among all of the components. In the case where a Ni compound is the main component, the content rate of the Ni compound but not the content rate of the Ni element is higher than other components. In the case where noble metals are the main component among all of the components, elements or compounds classified as noble metal are extracted, and the sum of the content rates of them may be higher than that of other components. Specifically, for example, in the case of 40Pt-20Rh-40Ni, since the sum of the content rate of noble metal Pt and the content rate of Rh is higher than the content rate of Ni, the main component is the noble metal.

However, since the fused part is formed by laser welding aiming at the joining surface between the noble metal member and the base part from a side of the ignition part, the fused part is exposed to air at the outer surface of the ignition part. Since the fused part is disposed on the upstream side from the base part on the path of the heat conduction from the ignition part to the ground electrode, the fused part is easily influenced by oxidation at high temperature in comparison to the base part due to the operation of the internal combustion engine. Therefore, according to the first and second aspects of the invention, the average ratio R of the components originated from the noble metal member among the components of the fused part at the points K1, K2, and K3 may satisfy by $R \geqq 60$ [%]. When the ratio R of the components originated from the noble metal member is equal to or higher than 60% at the portions close to an outer periphery of the fused part, that is, at the points K1, K2, and K3, the content rate of the noble metal at those portions can be increased so as to be relatively high, thereby improving the oxidation resistance and sufficiently preventing the generation of cracks, separation, and the like.

According to the first and second aspects of the invention, the average ratio R may satisfy $R \geqq 55$[%]. When the average ratio R is equal to or higher than 55%, high oxidation resistance can be obtained, thereby preventing the generation of cracks, separation, and the like. Even in the case where cracks occurs, when the cracks are very small, it is possible to sufficiently guarantee junction between the noble metal member and the base part by the fused part, thereby obtaining sufficient performance for the practical use of the spark plug.

According to the first and second aspects of the invention, the base part may be made of a different member from that of the ground electrode. The base part is formed of a different member from that of the ground electrode, and in regard to the base part, the difference between linear expansion coefficients of the noble metal member and the ground electrode is reduced. As described above, when the mixing ratio of the components originated from the noble metal member and the components originated from the base part in the fused part is regulated, it is possible to increase joining strength between the members, thereby preventing the generation of cracks, separation, and the like.

The increased joining strength between the noble metal member and the base part makes it possible to realize a configuration for reducing heat conduction from the noble metal member to the ground electrode. Specifically, according to the first and second aspects of the invention, when it is assumed that the thermal conductivity of the base part is W [W/(m·K)], the thermal conductivity of the ground electrode is X [W/(m·K)], and the thermal conductivity of the noble metal member is Y [W/(m·K)], the configuration may satisfy $Y>X\geqq W$. In the case where the relationship between the thermal conductivities is given, heat is more likely to remain in the noble metal member, however, when the temperature of the internal combustion engine itself is low particularly during the starting of the internal combustion engine, ignition to an air-fuel mixture can be properly performed when the noble metal member that is to be in contact with the spark discharge gap is at high temperature, thereby obtaining high ignition performance.

According to the first and second aspects of the invention, the noble metal member may mainly contain Pt and contain 1 wt % or more of one or more out of Ir, Rh, W, Pd, Ru, Re, Ni, Al, $Al_2O_3$, Y, and $Y_2O_3$. Using such a noble metal member is preferable to obtain high resistance to oxidation and spark consumption.

For further improvement of the ignition performance, so as to allow a flame kernel formed in the spark discharge gap to be hardly in contact with the ground electrode during the growth, the protruding amount of the ignition part from the side surface of the ground electrode may be increased. However, since the size of the spark discharge gap has to be guaranteed, the ground electrode itself needs to further protrude from the metal shell. Then, the amount of heat received from the combustion chamber of the ground electrode is increased, so that the heat conduction performance from the ignition part is alleviated and there is a concern that thermal load exerted on the ignition part will be further increased. However, in this case, according to the first and second aspects of the invention, when viewed from the cross-section of the ignition part bisected by the plane parallel with the protruding direction of the ignition part, the shortest distance from a position in the fused part in the axial direction, which is closest to the front end surface of the metal shell, to the front end surface may be equal to or greater than 4 mm. In the case where the ignition part is provided to have the above-mentioned configuration, the ignition part is exposed to severe use conditions. However, the spark plug, according to the first and second aspects of the invention which can prevent the generation of cracks, separation, and the like by regulating the mixing ratio of the components originated from the noble metal member and the components originated from the base part in the fused part and further enhancing the joining strength between the members, sufficiently endures under the severe condition and can be suitably used.

According to the first and second aspects of the invention, an area of a cross-section of the ground electrode which is perpendicular to a direction extending from the one end portion toward the other end portion is equal to or less than 4 $mm^2$. When the area of the cross-section forms a needle shape of 4 $mm^2$ or less, the heat flow rate on the path of the heat conduction is reduced, so that the heat conduction performance of the ignition part is alleviated. However, the spark plug, according to the first and second aspects of the invention which can enhance the joining strength between the members by regulating the mixing ratio of the components originated from the noble metal member and the components originated from the base part in the fused part, makes it possible to sufficiently prevent the generation of cracks, separation, and the like and can be suitably used.

BEST MODE FOR CARRYING OUT THE INVENTION

Figure 1:
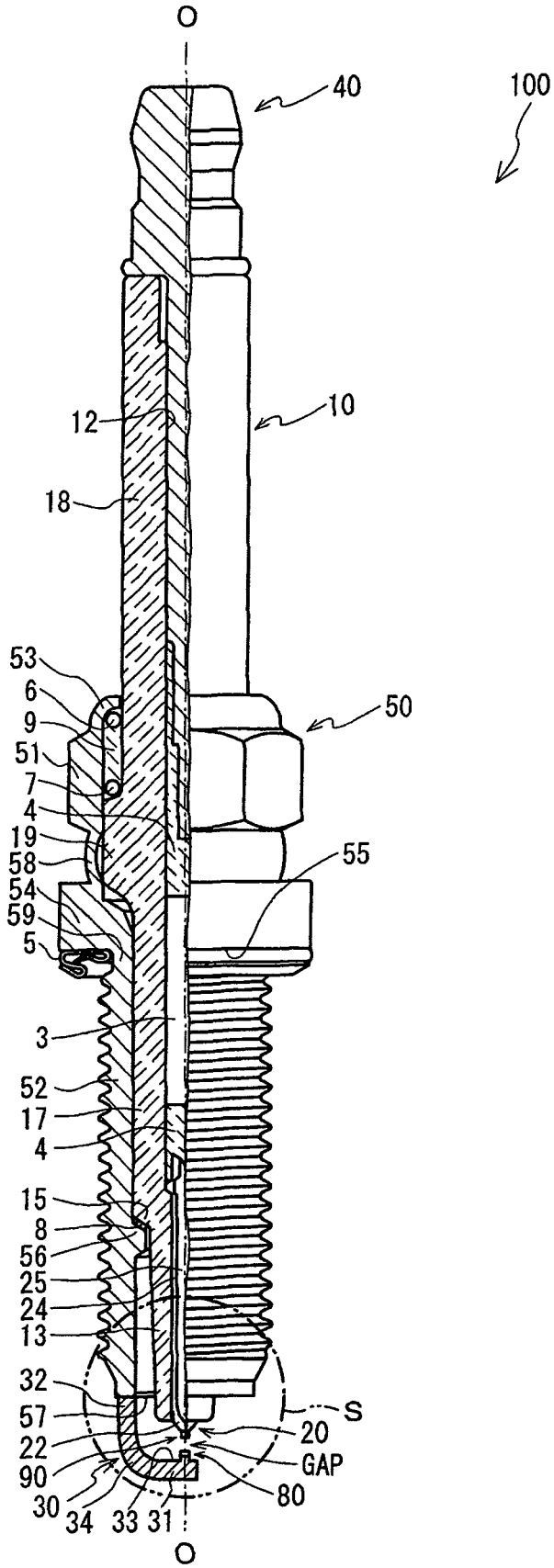
FIG. 1 is a partial sectional view of a spark plug 100.
Figure 2:
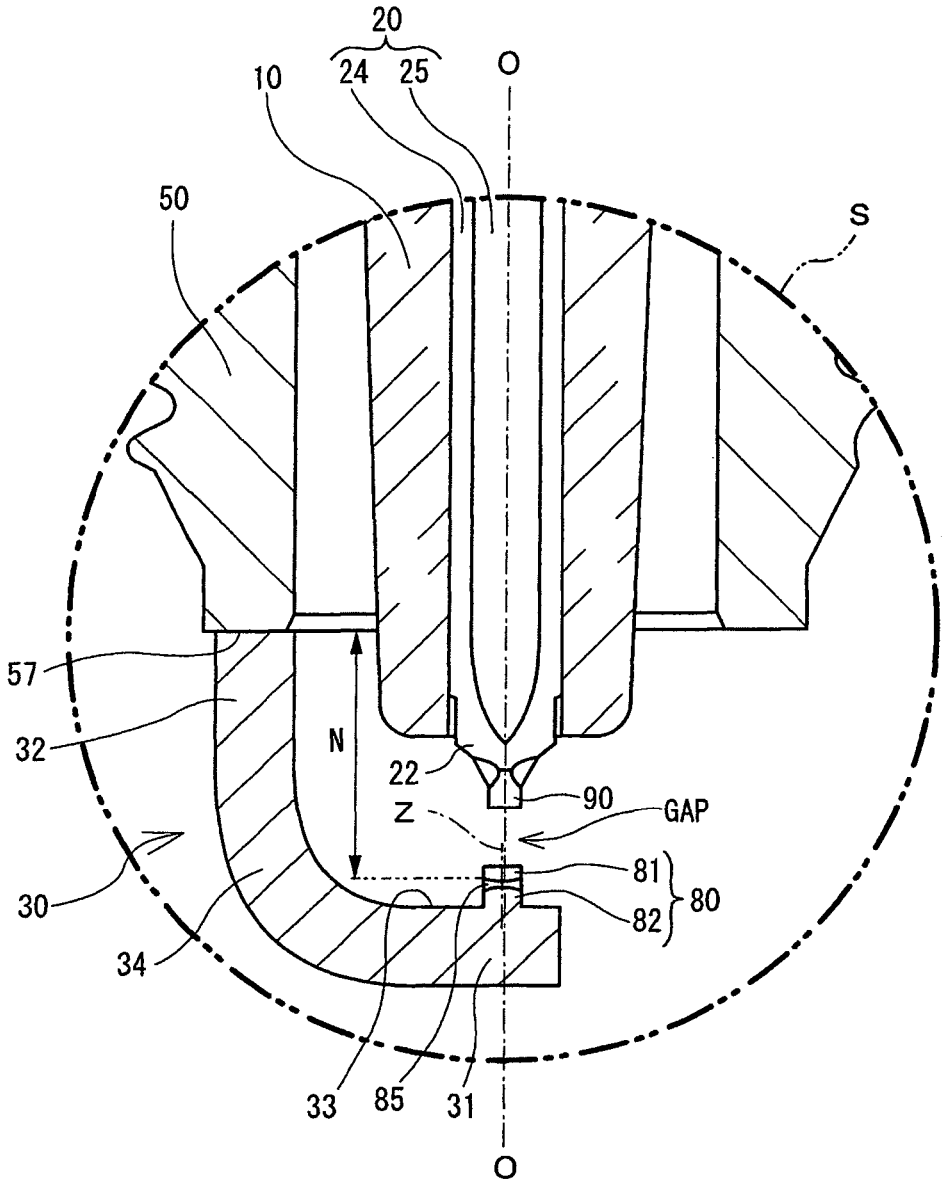
FIG. 2 is an enlarged partial sectional of a front end portion of the spark plug 100 shown as a dot-dot-dashed line S of FIG. 1.

Hereinafter, a spark plug according to an embodiment of the invention will be described with reference to the accompanying drawings. First, with reference to FIGS. 1 and 2, the configuration of the spark plug 100 as an example will be described. In FIGS. 1 and 2, an axial direction O of the spark plug 100 represents an up and down direction in the figure, and the lower side and the upper side represent the front end side and the rear end side of the spark plug 100.

As illustrated in FIG. 1, the spark plug 100, mainly, has a configuration in which a center electrode 20 is held on the front end side in an axial hole 12, a terminal metal fixture 40 on the rear end side is held by an insulator 10, and the radial periphery of the insulator 10 is surrounded and held by a metal shell 50. A ground electrode 30 is joined to a front end surface 57 of the metal shell 50, and the other end portion (front end portion 31) side is bent to face a front end portion 22 of the center electrode 20.

First, the insulator 10 of the spark plug 100 is described. The insulator 10 is, as well known, formed by performing firing on alumina and the like, and has a cylinder shape in which the axial hole 12 extends in the axial direction O at the axial center. A flange part 19 having the largest outer diameter is formed substantially at the center in the axial direction O, and a rear end side shank part 18 is formed on the rear end side (the upper side in FIG. 1) behind the flange part 19. A front end side shank part 17 having an outer diameter smaller than that of the rear end side shank part 18 is formed on the front end side (the lower side in FIG. 1) in front of the flange part 19. A long leg part 13 having an outer diameter smaller than that of the front end side shank part 17 is formed on the front end side in front of the front end side shank part 17. The diameter of the long leg part 13 is decreased as it goes to the front end side, and exposed to a combustion chamber when the spark plug 100 is mounted to the engine head (not shown) of the internal combustion engine. A step part 15 is formed in a step shape between the long leg part 13 and the frond end side shank part 17.

Next, the center electrode 20 is described. The center electrode 20 is a bar-shaped electrode having a structure in a core material 25 made of copper or an alloy mainly containing copper, which has a better heat conductivity than the base material 24, is buried in a base material 24 made of Ni or an alloy mainly containing Ni, such as, Inconel (Trademark) 600 or 601. The center electrode 20 is held in the axial hole 12 of the insulator 10 on the front end side. As illustrated in FIG. 2, the front end portion 22 of the center electrode 20 protrudes forward from a front end of the insulator 10 on the front end side. The front end portion 22 of the center electrode 20 is formed to have a smaller diameter as it goes to the front end side, and an electrode tip 90, made of a noble metal in order to improve spark consumption resistance, is joined to a front end surface of the front end portion 22.

A small gap is provided between an inner peripheral surface of the axial hole 12 in the vicinity of the front end of the insulator 10 and an outer peripheral surface of the center electrode 20 opposed to the inner peripheral surface. During heating, a corona discharge occurs in the gap, and carbon adhered in the vicinity of the front end of the insulator 10 is burnt out, so that the spark plug 100 can recover insulation resistance in the spark discharge gap. The center electrode 20, as illustrated in FIG. 1, extends toward the rear end side in the axial hole 12, and is electrically connected to the terminal metal fixture 40 on the rear side (the upper side in FIG. 1) via a conductive sealing member 4 and a ceramic resistor 3 extending along the axial direction O. The high pressure cable (not shown) is connected to the terminal metal fixture 40 via a plug cap (not shown), and a high voltage is applied.

Next, the metal shell 50 is described. The metal shell 50 illustrated in FIG. 1, is a shell having a cylindrical shape for fixing the spark plug 100 to the engine head (not shown) of the internal combustion engine. The metal shell 50 holds the insulator 10 with its cylindrical hole so as to surround a part extending from a portion of the rear end side shank part 18 of the insulator 10 to the long leg part 13. The metal shell 50 is formed of a low carbon steel material, and includes a tool engagement part 51 to which a spark plug wrench not shown is engaged, and a mounting screw part 52 provided with screw threads on which a mounting hole (not shown) of the engine head is screwed.

A flange-shaped sealing part 54 is formed between the tool engagement part 51 and the mounting screw part 52 of the metal shell 50. An annular-shaped gasket 5 which is formed by bending a plate member is insert-fitted to a screw head 59 between the mounting screw part 52 and the sealing part 54. The gasket 5 is, when the spark plug 100 is mounted to an mounting hole (not shown) of the engine head, pressed and crushed between a seating surface 55 of the sealing part 54 and an opening rim of the mounting hole to seal the space between the two, thereby preventing leakage of gas in the engine through the mounting hole.

On the rear end side of the metal shell 50 behind the tool engagement part 51, a thin swage part 53 is provided. Between the sealing part 54 and the tool engagement part 51, a buckling part 58 that is also thin like the swage part 53 is provided. Between an inner peripheral surface of the metal shell 50 extending from the tool engagement part 51 to the swage part 53 and an outer peripheral surface of the rear end side shank part 18 of the insulator 10, annular-shaped ring members 6 and 7 are interposed. Between the both ring members 6 and 7, a powder of talc (talcum) 9 is filled. By swaging the swage part 53 so as to be bent inward, the insulator 10 is pressed toward the front end side in the metal shell 50 with the ring members 6 and 7 and the talc 9 interposed therebetween. Accordingly, the step part 15 of the insulator 10 is supported by a step part 56 formed at an inner periphery of the metal shell 50 at a position of the mounting screw part 52 with an annular-shaped plate packing 8 interposed therebetween such that the metal shell 50 and the insulator 10 are united. Here, airtightness between the metal shell 50 and the insulator 10 is maintained by the plate packing 8, thereby preventing the leakage of combustion gas. The buckling part 58 is configured to be bent outward as compressive force is applied during swaging. By the buckling part 58, the compression length of the talc 9 in the direction of the axial O is increased, and thereby enhancing the airtightness of the metal shell 50.

Next, the ground electrode 30 is described. The ground electrode 30 illustrated in FIG. 2, is a bar-shaped electrode having a rectangular cross-section, and one end portion (a base end portion 32) thereof is joined to the front end surface 57 of the metal shell 50. It extends in the axial direction O from the base end portion 32, and is bent at its bent portion 34 such that a side surface (an inner surface 33) of the other end portion (a front end portion 31) faces the front end portion 22 of the center electrode 20. The ground electrode 30 is, similarly to the center electrode 20, made of Ni or an alloy mainly containing Ni, such as, Inconel (brand name) 600 or 601.

The front end portion 31 of the ground electrode 30 is provided with an ignition part 80 which has a column shape (a needle shape) with a sectional area of 4 $mm^2$ or less and protrudes toward the center electrode 20 by at least 0.5 mm from the inner surface 33. The ignition part 80 according to the embodiment is formed by joining, on the inner surface 33 of the ground electrode 30, a column-shaped noble metal member 81 to a protruding front end of a column-shaped base part 82 protruding toward the center electrode 20 from the inner surface 33. The noble metal member 81 mainly contains Pt and 1 wt % or more of one or more out of Ir, Rh, W, Pd, Ru, Re, Ni, Al, $Al_2O_3$, Y, $Y_2O_3$, and has excellent spark consumption resistance. Joining of the noble metal member 81 and the base part 82 of the ground electrode 30 to each other is performed by laser welding, and at a junction portion between the two, a fused part 85 is formed of construction materials (components) of the two that are fused and mixed with each other.

In the ignition part 80, the noble metal member 81 is provided at a position opposed to the front end portion 22 (more specifically, the electrode tip 90 joined to the front end portion 22) of the center electrode 20, and a spark discharge gap GAP is formed between the two. The ground electrode 30 is constructed so that the front end portion 31 protrudes more toward the front end of the axis line O direction. Specifically, the shortest distance N from a portion at a position in the fused part 85 of the ignition part 80, which is closest to the front end surface 57 of the metal shell 50 in the axial direction O, to the front end surface 57 is equal to or greater than 4 mm. That is, it is configured to provide the spark discharge gap GAP more to the center side than the combustion chamber when the spark plug 100 is assembled with the engine.

The corresponding relationship between the ignition part 80 and the front end portion 22 of the center electrode 20, which are opposed to each other, is enough as long as the spark discharge gap GAP between the two is formed, and the opposite surfaces (surfaces that face each other) of ignition part 80 and the electrode tip 90 may not need to have a strict corresponding relationship. Therefore, the axis O of the spark plug 100 and a center line Z of the ignition part 80 may not need to be strictly aligned with each other. Here, the center line Z of the ignition part 80 is referred to as a line which passes though the center of its cross-section perpendicular to the protruding direction (that is, the direction in which the ignition part 80 protrudes from the inner surface 33 of the ground electrode 30 toward the center electrode 20) of the ignition part 80 and is parallel with the protruding direction or an approximate line thereof.

In the spark plug 100 having the above-mentioned configuration according to the embodiment, as described above, joining of the noble metal member 81 and the base part 82 of the ignition part 80 is performed by laser welding. Specifically, the noble metal member 81 and the base part 82 are overlapped with each other in the protruding direction (the direction from the inner surface 33 to the center electrode 20, and the direction of the center line Z described later) of the ignition part 80. In this state, in order to aim at the joining surface between the noble metal member 81 and the base part 82, a laser beam is irradiated toward the center line Z from a side (an outer side in the radial direction in the case where the center line Z is used as an axis) to move round in the circumferential direction. Accordingly, between the noble metal member 81 and the base part 82, a fused part 85 is created formed of the construction materials (components) of the two that are fused and mixed with each other, and the ignition part 80 is formed in which the two are joined to each other in one body. The irradiation of the laser beam at this time can be performed continuously or intermittently, however, in the case of intermittent irradiation, it is preferable that the irradiation positions of the laser beam overlap with one another such that the position of the joining surface between the noble metal member 81 and the base part 82 is the fused part 85 when viewed from an outer peripheral side of the ignition part 80.

However, since there is a difference between the linear expansion coefficients of the noble metal member 81 mainly containing Pt and the base part 82 mainly containing Ni, there is a concern that cracks, separation, or the like may occur due to thermal stress in the vicinity of the boundary between the fused part 85 and the noble metal member 81 or the base part 82. To prevent this, it is preferable that the linear expansion coefficients of the fused part 85 approach that of the noble metal member 81 or the base part 82. Here, in the fused part 85, components originated from the noble metal member 81 and components originated from the base part 82 are mixed with each other, however, the mixing ratio of the components originated from each member is not uniform over the entire fused part 85 and is different with each portion of the fused part 85. On a side close to the noble metal member 81, the difference between the linear expansion coefficients can be reduced as the mixing ratio of the components originated from the noble metal member 81 is increased, so that resistance (strength to maintain the junction state of the two) to cope with the thermal stress in the vicinity of the boundary between the noble metal member 81 and the fused part 85 can be increased. Likewise, at a portion close to the base part 82, resistance to the thermal stress in the vicinity of the boundary between the base part 82 and the fused part 85 can be increased as the mixing ratio of the components originated from the base part 82 is increased. As described above, in order for the mixing ratio of the components originated from each member at each portion in the fused part 85 to be in the target range, various conditions can be set to be adjusted, such as the irradiation position, the irradiation angle, the output, the irradiation time, and the like of the laser beam during welding.

Above all, the resistance to the thermal stress in the vicinity of the boundary between the noble metal member 81 and the fused part 85 and the resistance to the thermal stress in the vicinity of the boundary between the base part 82 and the fused part 85 are different from each other, since the noble metal mainly contained in the noble metal member 81 and Ni mainly contained in the base part 82 are different materials. Since heat applied to the ignition part 80 while using the spark plug 100 is transferred from the side of the base part 82, there is a difference between the thermal stress exerted in the vicinity of the boundary between the noble metal member 81 and the fused part 85 and the thermal stress exerted in the vicinity of the boundary between the base part 82 and the fused part 85. From this point of view, in the fused part 85, the mixing ratios of the components originated from the noble metal member 81 at portions close to the noble metal member 81 or the mixing ratios of the components originated from the base part 82 at portions close to the base part 82 are not set to be uniform, but setting the mixing ratio according to portions is important to properly prevent the generation of cracks, separation, and the like due to the thermal stress. Therefore, according to this embodiment, the composition of the components of the fused part 85 at a particular portion of the fused part 85 is obtained, and the mixing ratio between the components originated from the noble metal member 81 and the components originated from the base part 82 at the particular portion is regulated.

Figure 3:
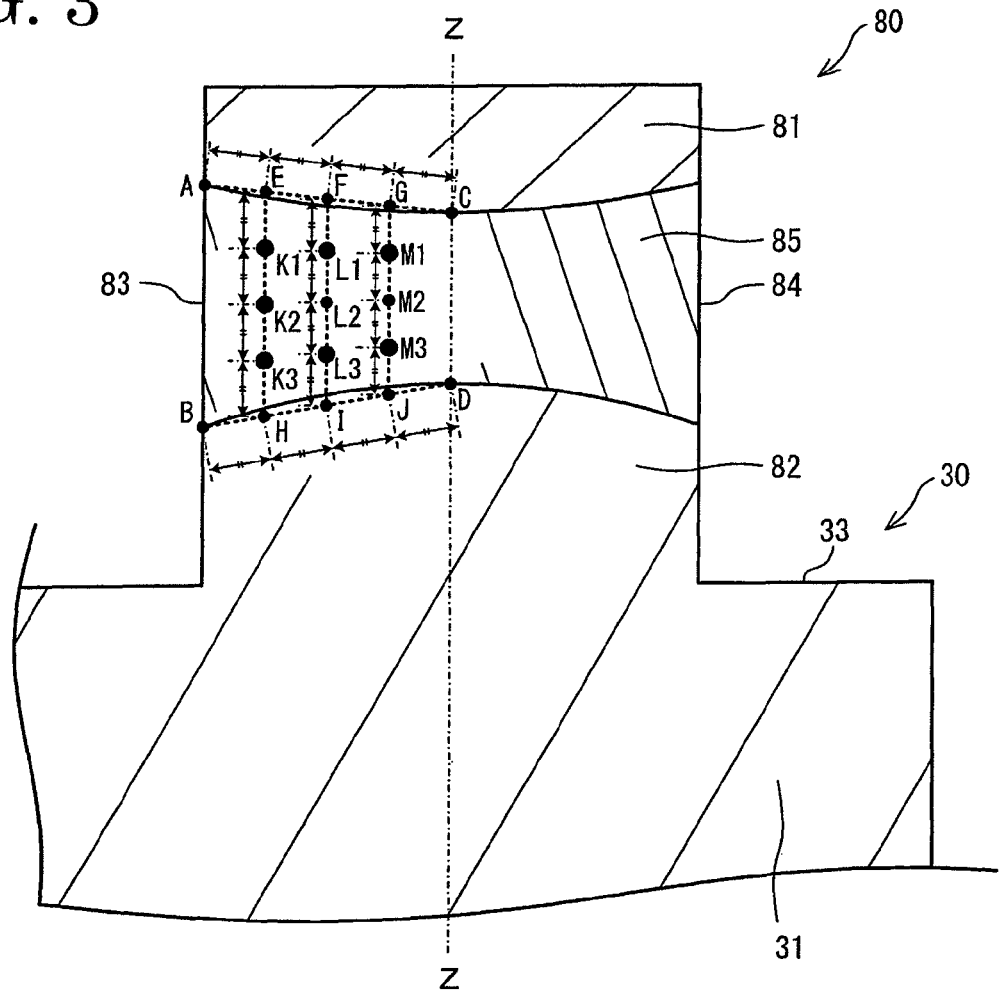
FIG. 3 is a sectional view of an ignition part 80 taken along the plane including a center line Z.

Hereinafter, regulation on the composition at a particular portion of the fused part 85 will be described with reference to the FIGS. 3 and 4. As illustrated in FIG. 3, according to this embodiment, the fused part 85 of the ignition part 80 is formed into a depth reaching the center line Z from a lateral side of the ignition part 80. That is, in a cross-section of the ignition part 80, between one side surface 83 and the other side surface 84 in a direction perpendicular to the center line Z in an outline of the ignition part 80, the fused part 85 continues between the both side surfaces 83 and 84.

In a cross-section of the fused part 85 having the above-mentioned shape, in the order represented as follows, particular portions (points A, B, C, D, E, F, G, H, I, J, K1 to K3, L1 to L3, and M1 to M3) are determined. First, on the one side surface 83 of the ignition part 80, a position of the boundary between the noble metal member 81 and the fused part 85 is referred to as the point A, and a position of the boundary between the fused part 85 and the base part 82 is referred to as the point B. A position of the boundary between the noble metal member 81 and the fused part 85, which is closest to the center line Z, is referred to as the point C, and likewise, a position of the boundary between the fused part 85 and the base part 82, which is closet to the center line Z is referred to as the point D. In the case of the ignition part 80 in which the fused part 85 continues between the both side surfaces 83 and 84, on the center line Z, the position of the boundary between the noble metal member 81 and the fused part 85 is referred to as the point C, and the position of the boundary between the base part 82 and the fused part 85 is referred to as the point D. Next, three equal division points dividing a line segment AC connecting the point A and the point C into four equal parts are referred to as the point E, the point F, and the point G in the order from the point A. Likewise, three equal division points dividing a line segment BD connecting the point B and the point D into four equal parts are referred to as the point H, the point I, and the point J in the order from the point B. Three equal division points dividing a line segment EH connecting the point E and the point H into four equal parts are referred to as the point K1, the point K2, and the point K3 in the order from the point E, and three equal division points dividing a line segment FI connecting the point F and the point I into four equal parts are referred to as the point L1, the point L2, and the point L3 in the order from the point F. Three equal division points dividing a line segment GJ connecting the point G and the point J into four equal parts are referred to as the point M1, the point M2, and the point M3 in the order from the point G.

Figure 4:
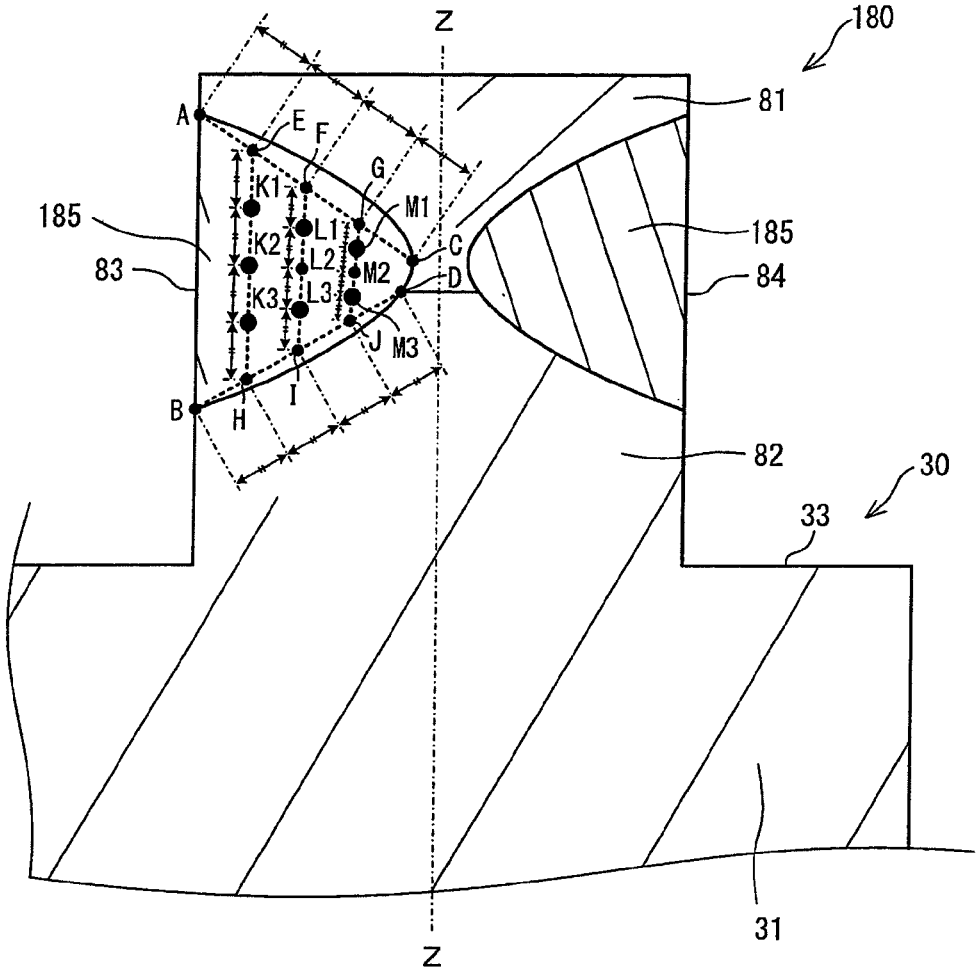
FIG. 4 is a sectional view of an ignition part 180 in which a fused part 185 of a different shape is formed, taken along the plane including the center line Z.

As illustrated in FIG. 4, even in the case where a fused part 185 formed in the ignition part 180 is not formed into a depth reaching the center line Z from the side surface 83 or the side surface 84, the order of the particular portions (points A, B, C, D, E, F, G, H, I, J, K1 to K3, L1 to L3, and M1 to M3) is determined likewise. First, on the one side surface 83 of an ignition part 180, a position of the boundary between the noble metal member 81 and the fused part 185 is referred to as the point A, and a position of the boundary between the fused part 185 and the base part 82 is referred to as the point B. A position of the boundary between the noble metal member 81 and the fused part 185, which is closest to the center line Z, is referred to as the point C, and likewise, a position of the boundary between the fused part 185 and the base part 82, which is closet to the center line Z is referred to as the point D. As illustrated in FIG. 4, in the case where the fused part 185 is formed to be slightly close to the noble metal member 81 in the direction of the center line Z, the point D is a position of an intersecting point of the joining surface between the noble metal member 81 and the base part 82, and the boundary between the base part 82 and the fused part 185. Here, although not shown in the figure, for example, in the case where laser welding is performed to allow the deepest position of the fused part to be a position of the joining surface between the noble metal member and the base part or the like, when the position of the boundary between the noble metal member and the fused part, which is closest to the center line Z and the position of the boundary between the fused part and the base part, which is closest to the center line Z are the same, the positions of the point C and the point D are the same. Next, as illustrated in FIG. 4, three equal division points dividing a line segment AC connecting the point A and the point C into four equal parts are referred to as the point E, the point F, and the point G in the order from the point A. Likewise, three equal division points dividing a line segment BD connecting the point B and the point D into four equal parts are referred to as the point H, the point I, and the point J in the order from the point B. Thereafter, likewise the above description, three equal division points dividing a line segment EH connecting the point E and the point H into four equal parts are referred to as the point K1, the point K2, and the point K3 in the order from the point E, and three equal division points dividing a line segment FI connecting the point F and the point I into four equal parts are referred to as the point L1, the point L2, and the point L3 in the order from the point F. Three equal division points dividing a line segment GJ connecting the point G and the point J into four equal parts are referred to as the point M1, the point M2, and the point M3 in the order from the point G.

In this embodiment, the composition of the fused part 85 at each of the particular portions, the point K1, the point L1, and the point M1 are measured, a ratio of the components originated from the noble metal member 81 is obtained at each particular portion, and when an average ratio P thereof is obtained, it is regulated so that P≧60 [%], and more preferably, P≧80 [%] is satisfied. Likewise, the composition of the fused part 85 at each of the particular portions, the point K3, the point L3, and the point M3 are measured, a ratio of the components originated from the base part 82 is obtained at each particular portion, and when an average ratio Q thereof is obtained, it is regulated so that Q≧20 [%] is satisfied. It is regulated so that the sum of the obtained average ratio P and the average ratio Q, P+Q≦160 [%] is satisfied. The composition of the fused part 85 at each of the particular portions, the point K1, the point K2, and the point K3 are measured, a ratio of the components originated from the noble metal member 81 is obtained at each particular portion, and when an average ratio R thereof is obtained, it is regulated so that R≧55 [%], and more preferably, R≧60 [%] is satisfied.

Here, at each particular portion of the fused part 85, a method of obtaining the average ratio of the components originated from a target member will be described. For example, the average ratio P of the components originated from the noble metal member 81 at each of the particular portions, the point K1, the point L1, and the M1 in the fused part 85 are obtained as follows.

(1) The composition of the noble metal member 81 and the composition of the base part 82 are measured in advance, the components of the two are compared to each other, and the components (specific components) contained in the noble metal member 81 that are not contained in the base part 82 are specified.

(2) Then, the composition of the fused part 85 at the particular portion, the point K1 is measured, and a content per unit (content rate) of the specific components of the noble metal member 81 contained therein is obtained.

(3) From the content rate of the specific component at the particular portion, the point K1, and the composition of the noble metal member 81, a mixing ratio of the components originated from the noble metal member 81 at the particular portion, the point K1, that is, a ratio of the components originated from the noble metal member 81 is estimated.

(4) (2) and (3) are performed on the particular portions, the point L1 and the point M1, and an average (average ratio P) of the ratios of the components originated from the noble metal member 81 at each of the particular portions, the point K1, the point L1, and the point M1 is obtained.

The average ratio Q of the components originated from the base part 82 at the particular portions, the point K3, the point L3, and the point M3 in the fused part 85, or the average ratio R of the components originated from the noble metal member 81 at the particular portions, the point K1, the point K2, and the point K3 are obtained in the same order described above.

It is proved from Example 1 described later that when the average ratio P of the components originated from the noble metal member 81 obtained at the particular portions, the point K1, the point L1, and the point M1 in the fused part 85 as described above, is equal to or higher than 80%, it is possible to sufficiently prevent the generation of cracks, separation, and the like in the vicinity of the boundary between the noble metal member 81 and the fused part 85. Above all, Example 1 was performed under severe experimental conditions, and according to Example 2 described later, it is proved that it is possible to sufficiently prevent the generation of cracks, separation, and the like even when P≧60 [%]. On the other hand, it is proved from Example 1 described later that when the average ratio Q of the components originated from the base part 82 at the particular portions, the point K3, the point L3, and the point M3 in the fused part 85 is equal to or higher than 20%, it is possible to sufficiently prevent the generation of cracks, separation, and the like in the vicinity of the boundary between the base part 82 and the fused part 85. When focused on P+Q obtained by adding the average ratio P to the average ratio Q, the mixing ratio of the components originated from the noble metal member 81 and the components originated from the base part 82 between the portion on the side of the noble metal member 81 and the portion of the side of the base part 82 in the fused part 85 is significantly changed as P+Q becomes higher. According to Example 1 described later, when P+Q is equal to or less than 160%, it could be seen that it is possible to reduce the generation of cracks, separation, and the like in the fused part 85 by preventing the change in the mixing ratio of the components originated from the noble metal member 81 and the components originated from the base part 82 in the fused part 85.

However, since the fused part 85 is formed by performing laser welding aiming the joining surface between the noble metal member 81 and the base part 82 from a side of the ignition part 80, the fused part 85 is exposed to air at the outer peripheral surface of the ignition part 80 having the center line Z as an axis. Since the fused part 85 is disposed on the upstream side from the base part 82 on the path of the heat conduction from the ignition part 80 to the ground electrode 30, it is easily influenced by oxidation at high temperature in comparison to the base part 82 due to the operation of the engine, and oxidative consumption of the fused part 85 occurs in the exposed portion under severe heating/cooling conditions, so that there is a concern that it causes the generation of cracks, separation, and the like. From this point of view, it is preferable that much noble metal having high oxidation resistance be included in the portion close to the outer peripheral surface of the ignition part 80 in the fused part 85. According to Example 3 described later, it can be seen that when the average ratio R of the components originated from the noble metal member 81 at the particular portions, the point K1, the K2, and the K3 is equal or higher than 60%, it is possible to sufficiently prevent the consumption of the fused part 85 due to the oxidation. It can be seen that even when the average ratio R is equal to or higher than 55%, it is possible to prevent the generation of cracks, separation, and the like caused by the oxidative consumption of the fused part 85, and although cracks occurs, the cracks are very small and does not cause the separation of the noble metal member 81. That is, when the average ratio R is equal to or higher than 55%, it is possible to sufficiently guarantee junction between the noble metal member 81 and the base part 82 by the fused part 85, thereby obtaining sufficient performance for the practical use of the spark plug 100.

In the ignition part 80 of which a sectional area perpendicular to its protruding direction (the direction of the center line Z) is equal to or less than 4 $mm^2$ and which has a column shape (needle shape) protruding from the inner surface 33 by at least 0.5 mm, the heat flow rate on the heat conduction path is reduced so that heat conduction performance is alleviated in comparison to the case where an ignition part having a larger sectional area is provided. However, as described above, by regulating the mixing ratio of the components originated from the noble metal member 81 and the components originated from the base part 82 in the fused part 85, and increasing the joining strength between the members, the ignition part 80 that can prevent the generation of cracks, separation, and the like can sufficiently endure more severe heating/cooling conditions.

The ignition part 80 is configured such that the shortest distance N from a portion at a position in the fused part 85, which is closest to the front end surface 57 of the metal shell 50 in the axial direction O, to the front end surface 57 is equal to or greater than 4 mm. That is, the front end portion 31 of the ground electrode 30 is configured to further protrude toward the front end side in the axial direction O, and it is configured to provide the spark discharge gap GAP more to the center side than the combustion chamber when the spark plug 100 is assembled with the engine not shown. This configuration is efficient to improve the ignition performance, however, on the other hand, the front end portion 31 of the ground electrode 30 needs to further protrude from the metal shell 50. Then, an amount of heat received from the combustion chamber of the ground electrode 30 is increased, so that the heat conduction performance from the ignition part 80 is alleviated, and there is a concern that the thermal load exerted on the fused part 85 is further increased. However, as described above, by regulating the mixing ratio of the components originated from the noble metal member 81 and the components originated from the base part 82 in the fused part 85, and increasing the joining strength between the members, the ignition part 80, that can prevent the generation of cracks, separation, and the like, can sufficiently endure more severe heating/cooling conditions.

Figure 7:
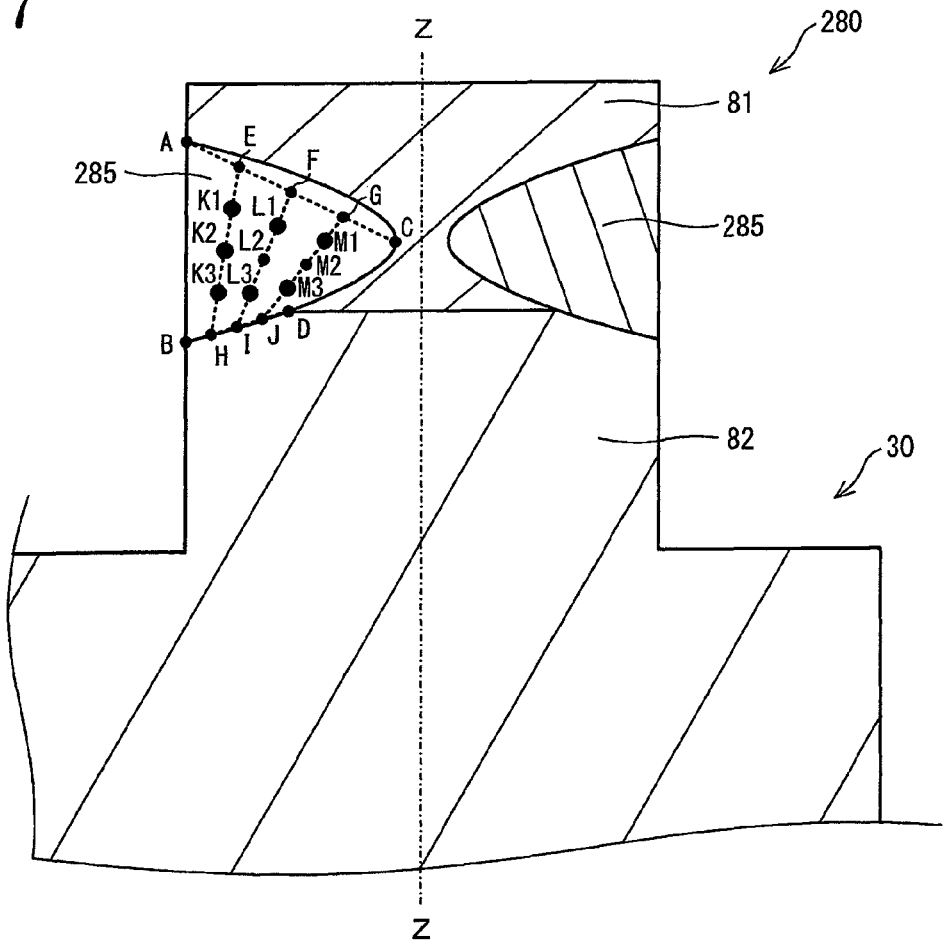
FIG. 7 is a sectional view of an ignition part 280, in which a fused part 285 of a different shape is formed, taken along the plane including the center line Z.
Figure 8:
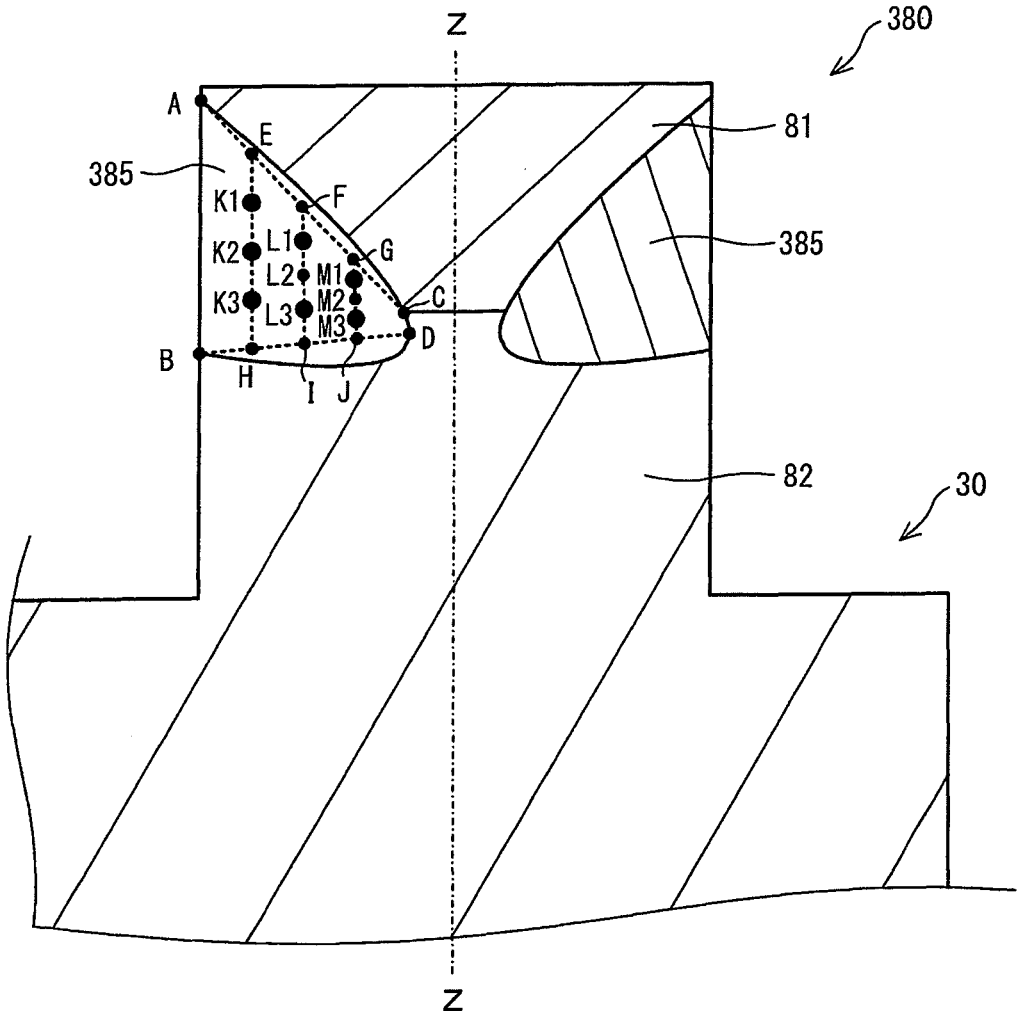
FIG. 8 is a sectional view of an ignition part 380, in which a fused part 385 of a different shape is formed, taken along the plane including the center line Z.

In order for the mixing ratio of the components originated from each member at each particular portion in the fused part 85 to be in a target range, various conditions are set as described above such as the irradiation position, the irradiation angle, the output, the irradiation time, and the like of the laser beam during welding. Specifically, like an ignition part 280 illustrated in FIG. 7, when the formation position (the irradiation position of the laser beam during laser welding) of a fused part 285 is determined as a position closer to the noble metal member 81 than the joining surface between the noble metal member 81 and the base part 82 along the center line Z, the mixing ratio of the components originated from the noble metal member 81 can be increased to be higher than that of the components originated from the base part 82 in the fused part 285. Otherwise, like an ignition part 380 illustrated in FIG. 8, when a fused part 385 is formed by irradiating a laser beam in a direction inclined with respect to the center line Z from a position close to the noble metal member 81 while aiming at the joining surface between the noble metal member 81 and the base part 82, similarly to the fused part 285 (see FIG. 7), the mixing ratio of the components originated from the noble metal member 81 in the fused part 385 can be increased to be higher than that of the components originated from the base part 82. When the particular portions are determined in the above-mentioned order even though the fused parts 285 and 385 are formed into the above shapes, by obtaining the average ratio P of the components originated from the noble metal member 81 at the particular portions, the points K1, L1, and M1, the mixing ratio in the vicinity of the boundary between the noble metal member 81 and the fused part 285 or 385 can be checked, and by obtaining the average ratio Q of the components originated from the base part 82 at the particular portions, the points K3, L3, and M3, the mixing ratio in the vicinity of the boundary between the noble metal member 81 and the fused part 285 or 385 can be checked.

It is needless to say that various modifications of the invention can be made. For example, joining of the noble metal member 81 and the base part 82 was performed by laser welding, however, electron beam welding may be performed. Laser welding is not limited to irradiating a laser beam in a direction perpendicular to the center line Z while aiming at the joining surface between the noble metal member 81 and the base part 82, and irradiating it in a direction inclined with respect to the center line Z while aiming at the joining surface between the noble metal member 81 and the base part 82 can be performed.

Figure 9:
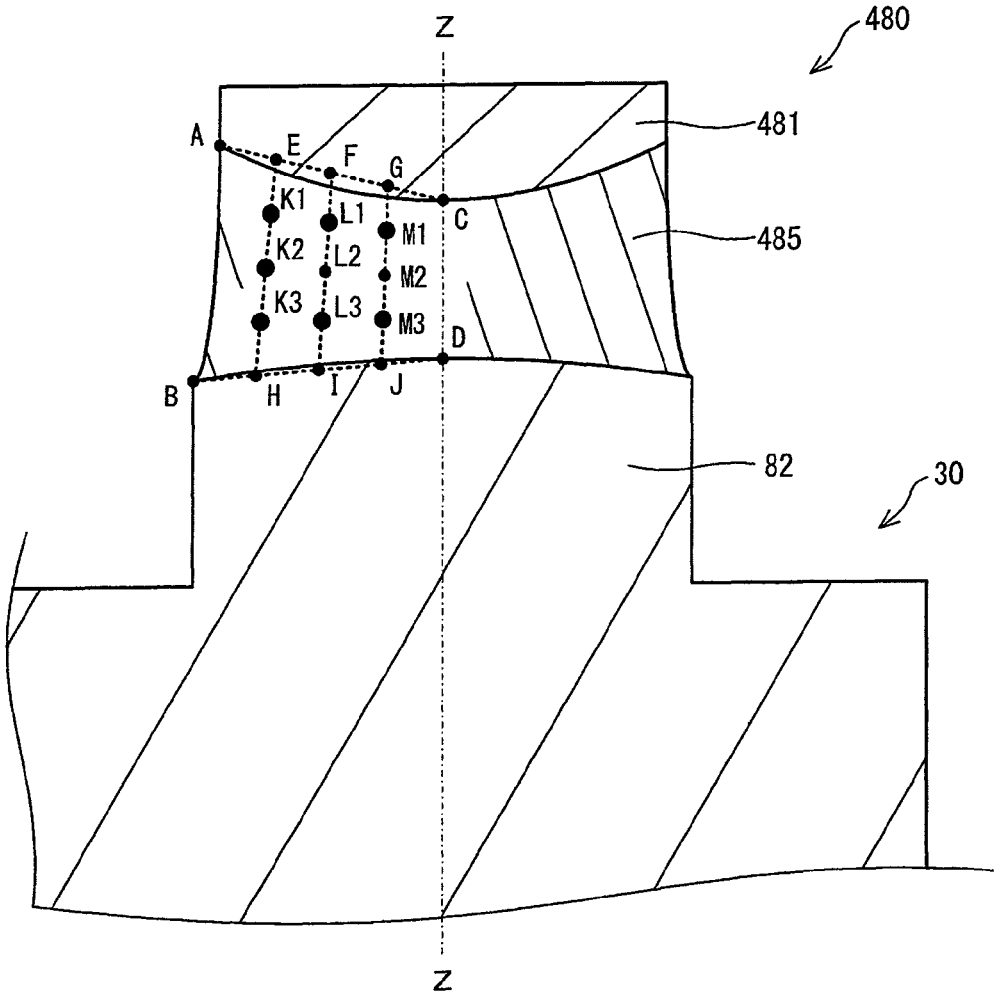
FIG. 9 is a sectional view of an ignition part 480, in which a fused part 485 of a different shape is formed, taken along the plane including the center line Z.

The invention can also be applied to one in which an outer diameter of a noble metal member 481 is smaller than that of the base part 82, or although not shown in the figure, to one in which an outer diameter of the noble metal member is greater than that of the base part, like an ignition part 480 illustrated in FIG. 9. Determining the particular portions in a fused part 485 formed between the noble metal member 481 and the base part 82 may be performed in the same order as that of this embodiment. That is, by obtaining an average ratio P of components originated from the noble metal member 481 at the particular portions, the points K1, L1, and M1, the mixing ratio in the vicinity of the boundary between the noble metal member 481 and the fused part 485 can be checked. By obtaining the average ratio Q of the components originated from the base part 82 at the particular portions, the points K3, L3, and M3, the mixing ratio in the vicinity of the boundary between the base part 82 and the fused part 485 can be checked.

Figure 10:
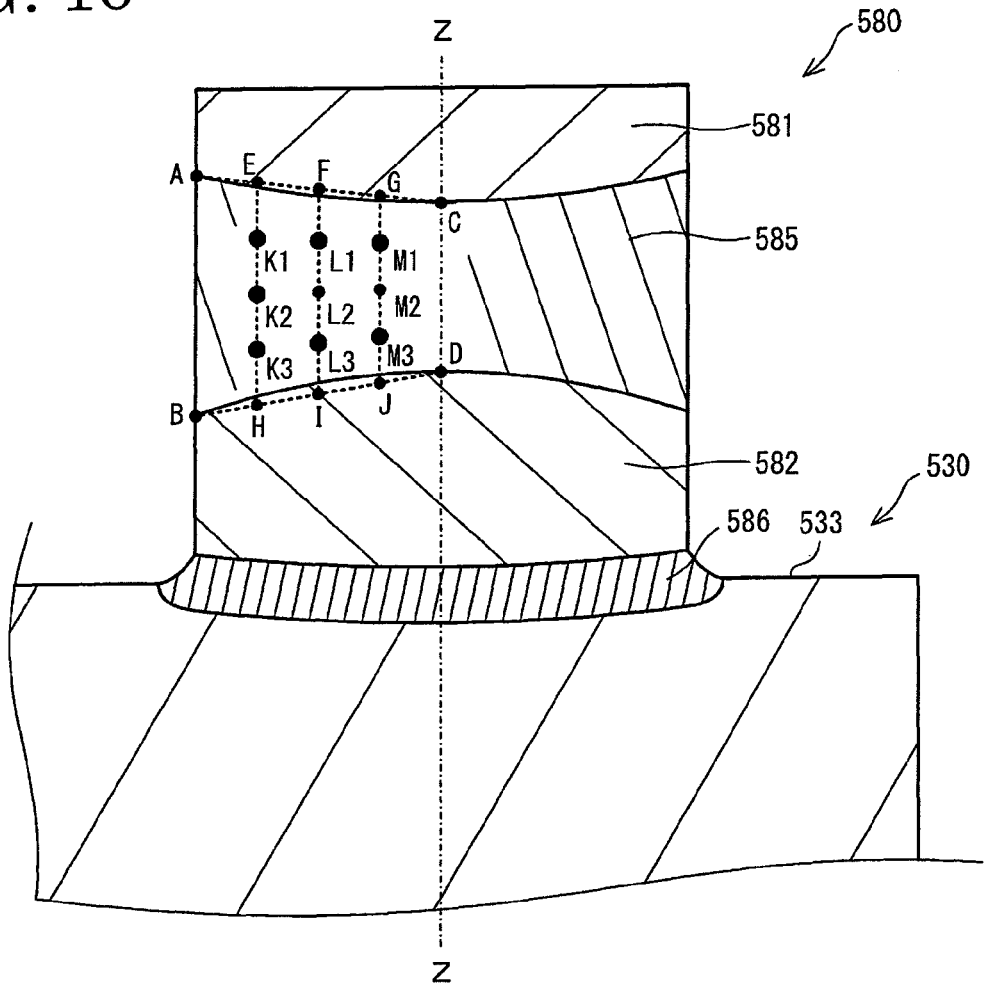
FIG. 10 is a sectional view of an ignition part 580, in which a fused part 585 of a different shape is formed, taken along the plane including the center line Z.

In order to achieve the additional improvement in the joining strength between the noble metal member 81 and the base part 82, like an ignition part 580 illustrated in FIG. 10, a base part 582 is made of a member different from that of the ground electrode 530, and at this time, the base part 582 may be allowed to have an intermediate linear expansion coefficient between a linear expansion coefficient of a noble metal member 581 and a linear expansion coefficient of a ground electrode 530. Since the base part 582 mainly contains Ni, sufficient joining strength can be obtained even when a fused part 586 is formed by performing resistance welding to join it to an inner surface 533 of a ground electrode 530 that is also made of Ni or mainly contains Ni. In regard to the ignition part 580 having the above shape, determining the particular portions in a fused part 585 may be performed in the same order as that of this embodiment. That is, by obtaining an average ratio P of components originated from the noble metal member 581 at the particular portions, the points K1, L1, and M1, the mixing ratio in the vicinity of the boundary between the noble metal member 581 and the fused part 585 can be checked. By obtaining the average ratio Q of the components originated from the base part 582 at the particular portions, the points K3, L3, and M3, the mixing ratio in the vicinity of the boundary between the base part 582 and the fused part 585 can be checked.

As described above, the ignition part 580 that can achieve the additional improvement in the joining strength between the noble metal member 581 and the base part 582 by providing the base part 582 as a different member between the noble metal member 581 and the ground electrode 530 makes it possible to realize a configuration for reducing heat conduction from the noble metal member 581 to the ground electrode 530. Specifically, when it is assumed that a thermal conductivity of the base part 582 is W [W/(m·K)], a thermal conductivity of the ground electrode 530 is X [W/(m·K)], and a thermal conductivity of the noble metal member 581 is Y [W/(m·K)], the configuration satisfies $Y>X\geqq W$. In the case where the relationship between the thermal conductivities is given, heat is more likely to gather in the noble metal member 581, however, when the temperature of the engine itself is low particularly during the starting of the engine, a flame-quenching for a flame kernel is reduced when the noble metal member 581 that is to be in contact with the spark discharge gap GAP (see FIG. 2) is at a high temperature, and ignition to an air-fuel mixture can be properly performed, thereby obtaining high ignition performance.

The same ignition part as that of the embodiment may be provided to a spark plug (not shown) in which a bent portion of a ground electrode is formed such that a front end portion of the ground electrode faces a side surface of a center electrode. In this case, the surface of the ground electrode which faces the side of the center electrode (the side surface of the center electrode) is defined as a side surface, the ignition part may be provided on the side surface. Otherwise, the same ignition part 80 as that in the embodiment may be provided instead of the electrode tip 90 (see FIG. 2) provided at the front end portion 22 of the center electrode 20.

EXAMPLE 1

As described above, an evaluation test was performed to check an advantage in regulating the components constituting the fused part 85 at a particular portion in the fused part 85 formed at the ignition part 80 of the spark plug 100. In this evaluation test, after joining of the noble metal member 81 to the base part 82 provided to the ground electrode 30 by laser welding, and manufacturing test samples of the spark plug 100 in which the ignition part 80 is formed, the irradiation portion, the irradiation angle, the output, the irradiation time, and the like of a laser beam were suitably set to be in the following ranges during the forming of the ignition part 80, to form various shapes of fused part 85.

Pulse width=1 to 30 msec

Pulse irradiation frequency: 5 to 24 times

Energy emitted for one irradiation: 1 to 3 J

Pulse waveform=rectangular or angular

Spot diameter=0.15 to 0.5 mm

Irradiation position: within ±0.1 mm in the axial direction Z from the position of the joining surface between the noble metal member and the base part.

By performing laser welding on the noble metal member 81 and the base part 82 by irradiating a laser beam under the above-mentioned set conditions, plural samples were prepared for each of the samples of the different shapes of fused part 85. Next, a sample was selected from every sample type and cut in a cross-section passing through the center line Z of its ignition part 80. Then, the composition of the fused part 85 at each of the particular portions, the points K1, K3, L1, L3, M1, and M3 determined as described above was obtained by measuring elements existing in each particular portion using a well-known EPMA (for example, WDS. spot diameter 20 μm, accelerating voltage 20 kV). Additionally, the average ratio P of the components originated from the noble metal member 81 at the particular portions, the points K1, L1, and M1, and the average ratio Q of the components originated from the base part 82 at the particular portions, the points K3, L3, and M3 were measured in the above-mentioned order. The samples types were classified by the combination of the obtained average ratios P and Q, and sample numbers were given. For each sample type, the sum of the average ratio P and the average ratio Q was obtained.

For each sample, after heating the front end portion 31 of the ground electrode 30 provided with the ignition part 80 in the ignition part 80 with a burner and maintaining the temperature of the front end portion 31 at 1000° C. for two minutes, cooling (slow cooling) was performed to decrease the temperature to 300° C. for one minute. This was set to a cycle, and after 1000 cycles, the ignition part 80 of each sample was cut in a cross-section passing through the center line Z, and the fused part 85 was observed using a magnifying glass. A portion of the fused part 85 in which cracks or separation occurs was observed, the numbers of occurrences were classified into the vicinity of the boundary between the noble metal member 81 and the fused part 85, the vicinity of the boundary between the base part 82 and the fused part 85, and the inside of the fused part 85, and lengths in the direction perpendicular to the center line Z were measured.

Figure 5:
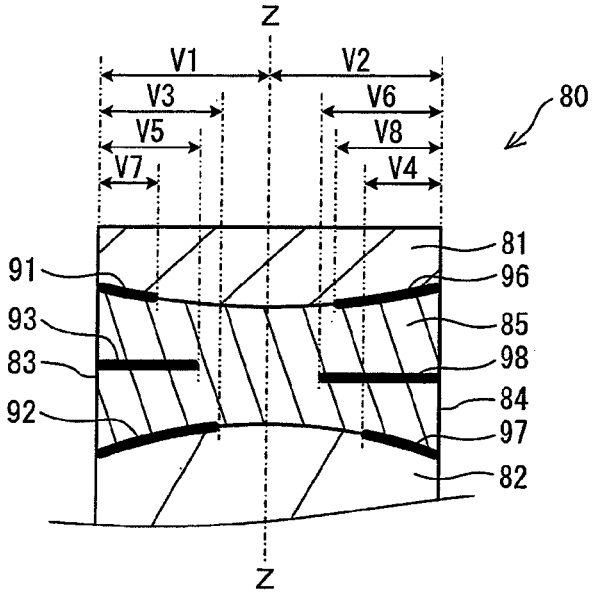
FIG. 5 is a view for explaining the shapes of cracks, separation, and the like that may occur in the ignition part 80.
Figure 6:
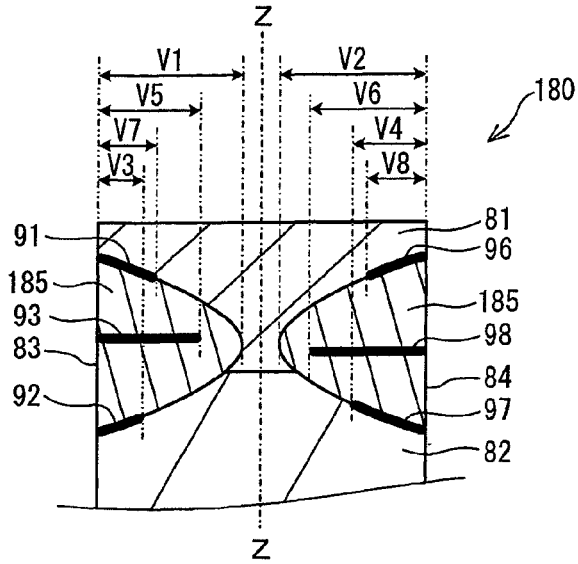
FIG. 6 is a view for explaining the shapes of cracks, separation, and the like that may occur in the ignition part 180.

Specifically, as illustrated in FIGS. 5 and 6, in the case where cracks, separation, and the like occurred in the vicinity of the boundary between the noble metal member 81 and the fused part 85 (the fused part 185 in FIG. 6), the generated shape was classified as α. Among generated crack/separation portions 91 and 96, the length of the crack/separation portion 91 extending from the one side surface 83 toward the center line Z, in the direction perpendicular to the center line Z was referred to as V7. Likewise, the length of the crack/separation portion 96 extending from the other side surface 84 toward the center line Z, in the direction perpendicular to the center line Z was referred to as V8. In the case where cracks, separation, and the like occurred in the vicinity of the boundary between the base part 82 and the fused part 85, the generated shape was classified as β. Among generated crack/separation portions 92 and 97, the length of the crack/separation portion 92 extending from the one side surface 83 toward the center line Z, in the direction perpendicular to the center line Z was referred to as V3. Likewise, the length of the crack/separation portion 97 extending from the other side surface 84 toward the center line Z, in the direction perpendicular to the center line Z was referred to as V4. In the case where cracks, separation, and the like occurred in the fused part 85, the generated shape was classified as γ. Among generated crack/separation portions 93 and 98, the length of the crack/separation portion 93 extending from the one side surface 83 toward the center line Z, in the direction perpendicular to the center line Z was referred to as V5. Likewise, the length of the crack/separation portion 98 extending from the other side surface 84 toward the center line Z, in the direction perpendicular to the center line Z was referred to as V6. The length of the fused part 85 on the side of the one side surface 83 from the center line Z was referred to as V1, and the length of the fused part 85 on the side of the other side surface 84 from the center line Z was referred to as V2. Specifically, in FIG. 5, the distance from the one side surface 83 to the center line Z was referred to as V1, and the distance from the other side surface 84 to the center line Z was referred to as V2. On the other hand, in FIG. 6, the distance from the one side surface 83 to the position in the fused part 185 on the side of the one side surface 83, which is closest to the center line Z, was referred to as V1, and the distance from the other side surface 84 to the position in the fused part 185 on the side of the other side surface 84, which is closest to the center line Z, was referred to as V2.

Then, for the generated crack, separation, and the like, the ratio ((V3+V4)/(V1+V2), (V5+V6)/(V1+V2) or (V7+V8)/(V1+V2)[×100(%)]) of the length (V3+V4, V5+V6 or V7+V8) of the crack/separation portions 91 to 93 and 96 to 98 to the length (V1+V2) of the fused part 85 was obtained. In the case where the obtained ratio was less than 50%, it was determined that there is sufficient resistance to thermal stress to maintain the junction state, and this was evaluated as "O". However, in the case where it was equal to or greater than 50%, it was determined that sufficient strength to cope with the thermal stress could not be obtained and there is a concern about the separation of the noble metal member 81, and this was evaluated as "X". The result of this evaluation test is shown in Table 1.

TABLE 1

| Sample | P [%] | Q [%] | P + Q [%] | Evaluation | Generated shape of crack, separation, and the like |
|---|---|---|---|---|---|
| 1 | 40 | 70 | 110 | X | α |
| 2 | 50 | 65 | 115 | X | α |
| 3 | 60 | 60 | 120 | X | α |
| 4 | 70 | 60 | 130 | X | α |
| 5 | 80 | 55 | 135 | O | — |
| 6 | 90 | 60 | 150 | O | — |
| 7 | 95 | 50 | 145 | O | — |

TABLE 1-continued

| Sample | P [%] | Q [%] | P + Q [%] | Evaluation | Generated shape of crack, separation, and the like |
|---|---|---|---|---|---|
| 8 | 95 | 5 | 100 | X | β |
| 9 | 95 | 10 | 105 | X | β |
| 10 | 95 | 20 | 115 | O | — |
| 11 | 95 | 30 | 125 | O | — |
| 12 | 90 | 40 | 130 | O | — |
| 13 | 90 | 70 | 160 | O | — |
| 14 | 90 | 80 | 170 | X | γ |
| 15 | 90 | 90 | 180 | X | γ |
| 16 | 60 | 10 | 70 | X | α, β |
| 17 | 70 | 95 | 165 | X | α, γ |

As shown in Table 1, in the samples 1 to 4 and 16 and 17, the average ratio P of the components originated from the noble metal member 81 at the particular portions (the points K1, L1, and M1 in FIG. 3) close to the noble metal member 81 of the fused part 85 was less than 80%, and in all of them, cracks, separation, and the like had occurred in the vicinity of the boundary between the noble metal member 81 and the fused part 85 (generated shape a). In the samples 8, 9, and 16, the average ratio Q of the components originated from the base part 82 at the particular portions (the points K3, L3, and M3 in FIG. 3) close to the base part 82 of the fused part 85 was less than 20%, and in all of them, cracks, separation, and the like had occurred in the vicinity of the boundary between the base part 82 and the fused part 85 (generated shape β). In the samples 14, 15 and 17, the sum of the average ratio P and the average ratio Q was higher than 160%, and in all of them, cracks, separation, and the like had occurred in the fused part 85 (generated shape γ). Particularly, in the sample 16, cracks, separation, and the like had occurred in combination of the generated shape α and the generated shape β, and in the sample 17, they had occurred in combination of the generated shape α and the generated shape γ. However, in the samples 5 to 7 and 10 to 13 satisfying all of P≧80 [%], Q≧20 [%], and P+Q≦160 [%], large cracks, separation, and the like which may cause the junction between the noble metal member 81 and the base part 82 not to be maintained, had not occurred.

EXAMPLE 2

By changing the heating condition to 950° C. in the heating/cooling test performed for each sample (the samples 1 to 17) of Example 1 and maintaining other conditions, an evaluation test was performed. That is, this evaluation test was performed by reducing the load exerted on the ignition part 80 in the heating/cooling cycles using the burner in comparison to Example 1. After the test, a cross-section of the ignition part 80 passing through the center line Z was observed, and on the same evaluation basis as that of Example 1, the case where the generation of cracks, separation, and the like that may cause the separation of the noble metal member 81 were found and the case where it were not found were respectively evaluated as "X" and "O". The result of the evaluation test is shown in Table 2.

TABLE 2

| Sample | P [%] | Q [%] | P + Q [%] | Evaluation | Generated shape of cracks, separation, and the like |
|---|---|---|---|---|---|
| 1 | 40 | 70 | 110 | X | α |
| 2 | 50 | 65 | 115 | X | α |

TABLE 2-continued

| Sample | P [%] | Q [%] | P + Q [%] | Evaluation | Generated shape of cracks, separation, and the like |
|---|---|---|---|---|---|
| 3 | 60 | 60 | 120 | O | — |
| 4 | 70 | 60 | 130 | O | — |
| 5 | 80 | 55 | 135 | O | — |
| 6 | 90 | 60 | 150 | O | — |
| 7 | 95 | 50 | 145 | O | — |
| 8 | 95 | 5 | 100 | X | β |
| 9 | 95 | 10 | 105 | X | β |
| 10 | 95 | 20 | 115 | O | |
| 11 | 95 | 30 | 125 | O | — |
| 12 | 90 | 40 | 130 | O | — |
| 13 | 90 | 70 | 160 | O | — |
| 14 | 90 | 80 | 170 | X | γ |
| 15 | 90 | 90 | 180 | X | γ |
| 16 | 60 | 10 | 70 | X | α, β |
| 17 | 70 | 95 | 165 | X | α, γ |

When the result of this evaluation test shown in Table 2 is compared to the result (see Table 1) of the evaluation test of Example 1, the generation of large cracks, separation, and the like which may cause the junction between the noble metal member 81 and the base part 82 not to be maintained was not observed in the new samples 3 and 4. Both the samples 3 and 4 satisfy Q≧20 [%] and P+Q≦160 [%], but do not satisfy P≧80 [%]. Likewise, in comparison to the samples 1 and 2 which satisfy Q≧20 [%] and P+Q≦160 [%] but do not satisfy P≧80 [%], the samples 3 and 4 satisfied P≧60 [%], but the samples 1 and 2 satisfied P≦60 [%]. As described above, this evaluation test was performed under more moderate heating/cooling condition than Example 1, and this test condition is close to the condition for the practical use of the spark plug 100. According to the result of the evaluation test, it could be shown that junction between the noble metal member 81 and the base part 82 was sufficiently guaranteed although P≧60 [%].

EXAMPLE 3

Next, in order to confirm the conditions for preventing the generation of cracks, separation, and the like under more severe heating/cooling condition than Example 1, an evaluation test was performed. Since the fused part 85 is formed by performing laser welding aiming at the joining surface between the noble metal member 81 and the base part 82 from a side of the ignition part 80, the irradiation portion of the laser beam is exposed to the outside. Under the more severe heating/cooling condition, oxidative consumption of the fused part 85 occurs in the exposed portion, and there is a concern that it causes the generation of cracks, separation, and the like. Consequently, in this example, there was a focus on the average ratio R of the components originated from the noble metal member 81 at the particular portions, the points K1, K2, and K3 in the fused part 85.

Then, among the test samples of the spark plug 100 manufactured in Example 1, the sample 12 and the sample 5 that can prevent the generation of cracks, separation, and the like were used as comparative samples in an evaluation test of Example 3. For the sample 12 and the sample 5, the average ratios R of the components originated from the noble metal member 81 at the particular portions, the points K1, K2, and K3 in the fused part 85 were obtained as in Example 1, and they respectively were 50% and 60%. From the plural sample types manufactured as in Example 1, the samples having the same average ratio P and the average ratio Q as those of the sample 12 and the average ratios R of 60% and 70% were extracted, and sample numbers were respectively given to them as a sample 18 and a sample 19. Likewise, the samples having the same average ratio P and the average ratio Q as those of the sample 5 and the average ratios R of 55%, 50%, and 40% were extracted, and sample numbers were respectively given to them as a sample 22, a sample 20, and a sample 21.

For each sample, the heating/cooling test the same as that of Example 1 was performed by changing the heating condition to 1100° C. and leaving the other conditions as they were. After the test, a cross-section passing through the center line Z was observed, and on the same evaluation basis as that of Example 1, the case where the generation of cracks, separation, and the like which may cause the separation of the noble metal member 81 were found, the case where it can be determined that there is no concern of the separation of the noble metal member 81 although the generation of very small cracks were found, and the case where cracks were not found were respectively evaluated as "X", "O", and "Δ". The result of the evaluation test is shown in Table 3.

TABLE 3

| Sample | P [%] | Q [%] | P + Q [%] | R [%] | Evaluation |
|---|---|---|---|---|---|
| 12 | 90 | 40 | 130 | 50 | X |
| 18 | 90 | 40 | 130 | 60 | Δ |
| 19 | 90 | 40 | 130 | 75 | Δ |
| 5 | 80 | 55 | 135 | 60 | Δ |
| 22 | 80 | 55 | 135 | 55 | O |
| 20 | 80 | 55 | 135 | 50 | X |
| 21 | 80 | 55 | 135 | 40 | X |

As shown in Table 3, when the samples 12, 18, and 19 having the same average ratios P and Q are compared with each other, in the sample 12 in which the average ratio R of the components originated from the noble metal member 81 at the particular portions, the points K1, K2, and K3 in the fused part 85 does not satisfy 60%, cracks, separation, and the like had occurred caused by oxidative consumption of the fused part 85. However, in the samples 18 and 19 having the average ratio R of 60%, cracks were not found, and the generation of cracks, separation, and the like could be sufficiently prevented. Likewise, when the samples 5, 22, 20, 21 having the same average ratios P and Q are compared with each other, in the sample 20 and 21 in which the average ratio R of the components originated from the noble metal member 81 at the particular portions, the points K1, K2, and K3 in the fused part 85 does not satisfy 55%, cracks, separation, and the like had occurred caused by oxidative consumption of the fused part 85. Although the generation of cracks were found in the sample 22 having the average ratio R of 55%, the cracks were very small, and it was determined that there is no concern of the generation of the noble metal member 81 due to the cracks. In the sample 5 having the average ratio R of 60%, cracks were not found, and the generation of cracks, separation, and the like could be sufficiently prevented. By putting together the evaluation result of the samples 12, 18, and 19 and the evaluation result of the samples 5, 22, 20, and 21, when the average ratio R is equal to or higher than 55%, it is possible to prevent the generation of cracks, separation, and the like caused by the oxidative consumption of the fused part 85, and even when cracks occurred, the cracks are very small, so that the separation of the noble metal member 81 will not be caused. That is, junction between the noble metal member 81 and the base part 82 by the fused part 85 can be sufficiently guaranteed, so that it is possible to obtain sufficient performance for the practical use of the spark plug 100. Preferably, it could be seen that when the average ratio R is equal to or higher than 60%, the generation of cracks, separation, and the like could be sufficiently prevented, and sufficient reliability in terms of oxidation resistance could be guaranteed.

The invention claimed is:

1. A spark plug comprising:

a center electrode;

an insulator which has an axial hole extending along an axial direction thereof and holds the center electrode in the axial hole;

a metal shell which circumferentially surrounds and holds the insulator;

a ground electrode which has one end portion that is joined to a front end surface of the metal shell and the other end portion that is bent such that a side surface thereof faces a front end portion of the center electrode; and an ignition part which protrudes from the side surface toward the center electrode by at least 0.5 mm or more, at a position opposed to the front end portion of the center electrode, on the side surface of the other end portion of the ground electrode, wherein the ignition part includes:

a base part that does not include a noble metal, wherein Ni is a main component of the base part having the highest content rate among all the components, and has a shape protruding from the side surface toward the center electrode;

a noble metal member which mainly contains noble metal, is joined to a protruding front end of the base part, and forms a spark discharge gap between itself and the front end portion of the center electrode; and a fused part formed by laser-welding the noble metal member and the base part from a side to fuse construction materials of the two together, wherein when viewed from a cross-section of the ignition part bisected by a plane parallel with a protruding direction of the ignition part, the fused part is formed between the noble metal member and the base part, into a shape extending from each of one side surface of the ignition part and the other side surface in a direction perpendicular to the protruding direction of the ignition part, toward the center line that passes through the center between the both side surfaces along the protruding direction of the ignition part, wherein, in a cross-section of the ignition part, where a point A represents a position of a boundary between the noble metal member and the fused part at the one side surface, a point B represents a position of a boundary between the base part and the fused part at the one side surface, a point C represents a position of a boundary between the noble metal member and the fused part, which is closest to the center line, a point D represents a position of a boundary between the base part and the fused part, which is closest to the center line, a point E, a point F and a point G represent three equal division points dividing a line segment AC as a straight line connecting the point A and the point C into four equal parts, respectively, in the order from the point A, a point H, a point I, and a point J represent three equal division points dividing a line segment BD as a straight line connecting the point B and the point D into four equal parts, respectively, in the order from the point B, a point K1, a point K2, and a point K3 represent three equal division points dividing a line segment EH as a straight line connecting the point E and the point H into four equal parts, respectively, in the order from the point E, a point L1, a point L2, and a point L3 represent three equal division points dividing a line segment Fl as a straight line connecting the point F and the point I into four equal parts, respectively, in the order from the point F, and a point M1, a point M2, and a point M3 represent three equal division points dividing a line segment GJ as a straight line connecting the point G and the point J into four equal parts, respectively, in the order from the point G, an average ratio P of components originated from the noble metal member among components of the fused part at the points K1, L1, and M1 satisfies P≧80 [%], an average ratio Q of components originated from the base part among components of the fused part at the points K3, L3, and M3 satisfies Q≧20[%], and P+Q≦160 [%] is satisfied.

2. The spark plug according to claim 1, wherein an average ratio R of components originated from the noble metal member among components of the fused part at the points K1, K2, and K3 satisfies R≧55[%].

3. The spark plug according to claim 2, wherein the average ratio R satisfies R≧60 [%].

4. The spark plug according to claim 1, wherein the base part is made of a different member from that of the ground electrode.

5. The spark plug according to claim 4, wherein, where W [W/(m·K)] represents a thermal conductivity of the base part, X [W/(m·K)] represents a thermal conductivity of the ground electrode, and Y [W/(m·K)] represents a thermal conductivity of the noble metal member, Y>X≧W is satisfied.

6. The spark plug according to claim 1, wherein the noble metal member mainly contains Pt and contains 1 wt % or more of one or more selected from Ir, Rh, W, Pd, Ru, Re, Ni, Al, $Al_2O_3$, Y, and $Y_2O_3$.

7. The spark plug according to claim 1, wherein, when viewed from the cross-section of the ignition part bisected by the plane parallel with the protruding direction of the ignition part, the shortest distance from a position in the fused part in the axial direction, which is closest to the front end surface of the metal shell, to the front end surface is equal to or greater than 4 mm.

8. The spark plug according to claim 1, wherein an area of a cross-section of the ground electrode which is perpendicular to a direction extending from the one end portion toward the other end portion is equal to or smaller than 4 $mm^2$.

9. The spark plug according to claim 1, wherein the average ratio P satisfies P≧80 [%].

* * * * *